US007681731B1

(12) United States Patent
Chern

(10) Patent No.: US 7,681,731 B1
(45) Date of Patent: Mar. 23, 2010

(54) TOOL BOX

(76) Inventor: Shwu Ruu Chern, No. 1, Alley 16, Lane 40, Jinde Road, East District, Taichung City 40141 (TW)

( * ) Notice: Subject to any disclaimer, the term of this patent is extended or adjusted under 35 U.S.C. 154(b) by 526 days.

(21) Appl. No.: 11/707,719

(22) Filed: Feb. 20, 2007

(51) Int. Cl.
*B65D 85/28* (2006.01)

(52) U.S. Cl. ..... 206/372; 208/373; 208/349

(58) Field of Classification Search ..... 206/372, 206/373, 376, 745, 747, 581, 561
See application file for complete search history.

(56) References Cited

U.S. PATENT DOCUMENTS 5,358,100 A * 10/1994 Wolff ..... 206/749
5,524,915 A * 6/1996 Liu ..... 280/30
5,826,719 A * 10/1998 Chen ..... 206/373
6,450,354 B2 * 9/2002 Chien ..... 220/4.01
6,905,015 B2 * 6/2005 Hernandez et al. ..... 206/45.24
2004/0168941 A1 * 9/2004 Cho ..... 206/373
2006/0108245 A1 * 5/2006 Lee ..... 206/373

* cited by examiner

*Primary Examiner*—Ehud Gartenberg
*Assistant Examiner*—King M Chu

(57) ABSTRACT

A tool box includes a base having a plurality of first recesses and two connection portions are connected on two sides of the base. Each connection portion has an elongate recess defined therein. Two pivotable side portions are pivotably connected to the two connection portions of the base and each side portion has a plurality of second recesses defined therein. The two side portions are sized to cover a top of the base. A space is defined in the base and opens to an end of the base, a slidable portion is slidably received in the space.

6 Claims, 7 Drawing Sheets

TOOL BOX

FIELD OF THE INVENTION

The present invention relates to a tool box having two pivotable side portions and a slidable portion so as to receive more parts and tools.

BACKGROUND OF THE INVENTION

A conventional tool box generally includes a base and a cover which is pivotably connected to a side of the base. Each of the base and the cover has a plurality of recesses so as to receive tools and parts therein. The conventional tool box has only the recesses in the base and the cover to receive tools and parts, and the space for receiving the tools and parts are not sufficient for some users who need prepare a lot of tools and parts. Besides, the cover has only two positions which are the opened position and the closed position, and once the cover is in opened position, both of the base and the cover occupy a large area which is not permitted in some situations.

The present invention intends to provide a tool box that has two side portions and one slidable portion, each of the three portions receives tools and parts and can be pivoted or slid relative to the base individually.

SUMMARY OF THE INVENTION

The present invention relates to a tool box which comprises a base having a plurality of first recesses defined therein and two connection portions are connected on two sides of the base so as to be pivotably connected with two side parts. Each connection portion has two end parts and an elongate recess is defined between the two end parts. The two pivotable side portions each have a plurality of second recesses. The two side portions are sized to cover a top of the base.

The primary object of the present invention is to provide a tool box with two pivotable side portions and a slidable portion, each of which can be individually operated and receives tools and parts.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
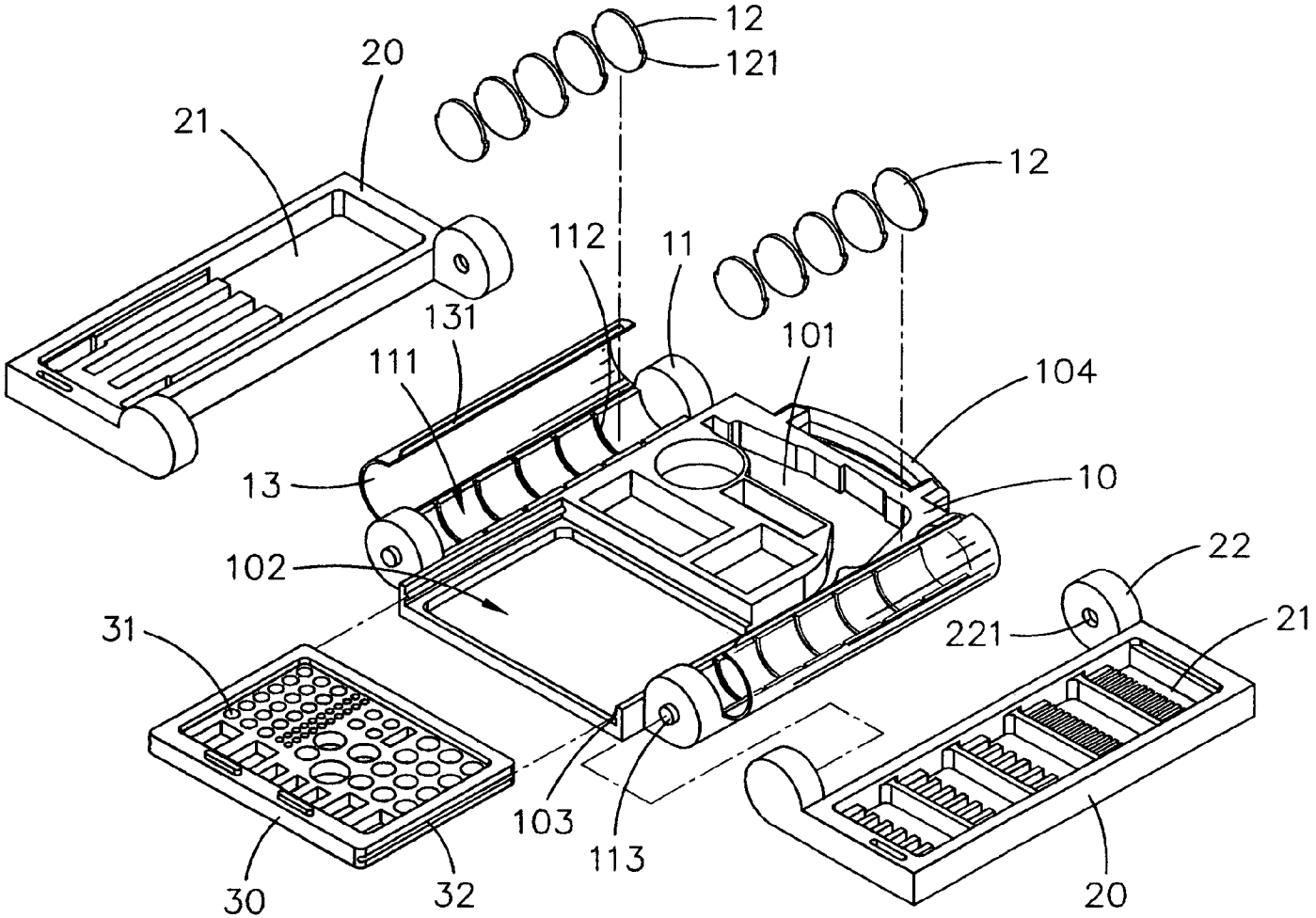
FIG. 1 is an exploded view to show the tool box of the present invention.
Figure 2:
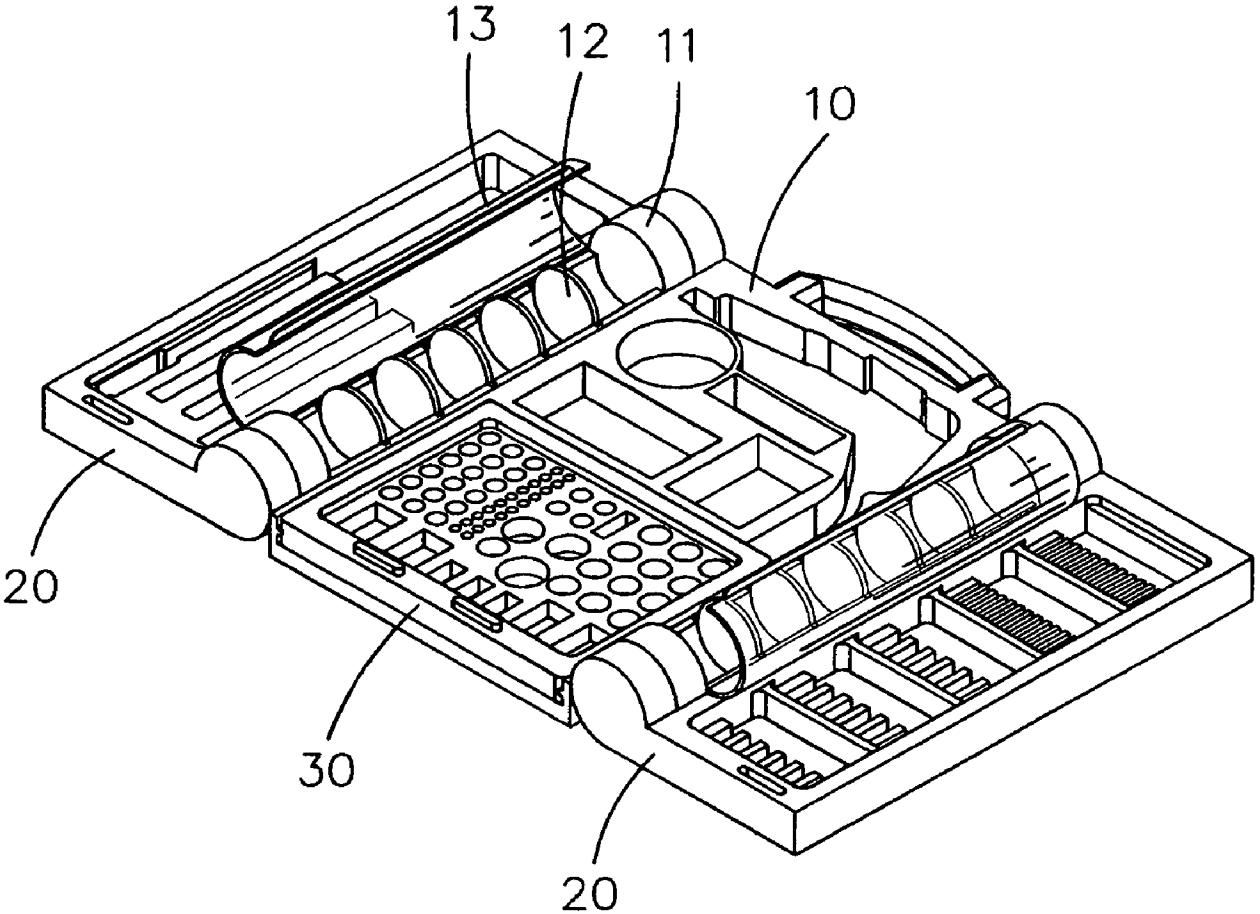
FIG. 2 is a perspective view to show that the two side portions are in their opened positions of the tool box of the present invention.

Referring to FIGS. 1 to 6, the tool box of the present invention comprises a base 10 which has a plurality of first recesses 101 defined in a top thereof and a handle 104 is connected to an end of the base 10. Two connection portions are connected on two sides of the base 10 and each connection portion has two end parts 11 and an elongate recess 111 is defined between the two end parts 11. A plurality of grooves 112 are defined in an inner side of each of the elongate recess 111 and a plurality of separation plates 12 are engaged with the grooves 112. The grooves 112 are located in equal distance separated apart and each separation plates 12 includes a engaging periphery 121 which is engaged with the groove 112 corresponding thereto.

Tools and parts can be received in the partitions separated by the separation plates 12 in the side portions.

Figure 3:
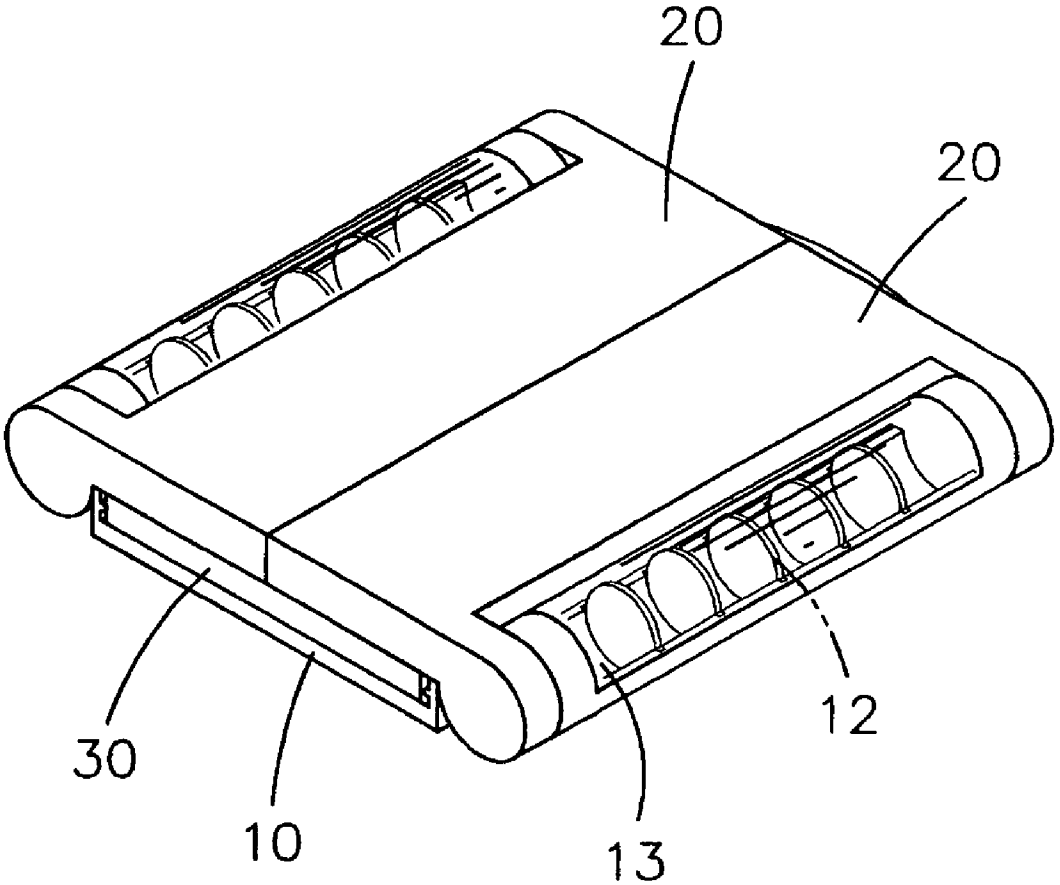
FIG. 3 is a perspective view to show that the two side portions are pivoted onto the top of the base of the tool box of the present invention.
Figure 4:
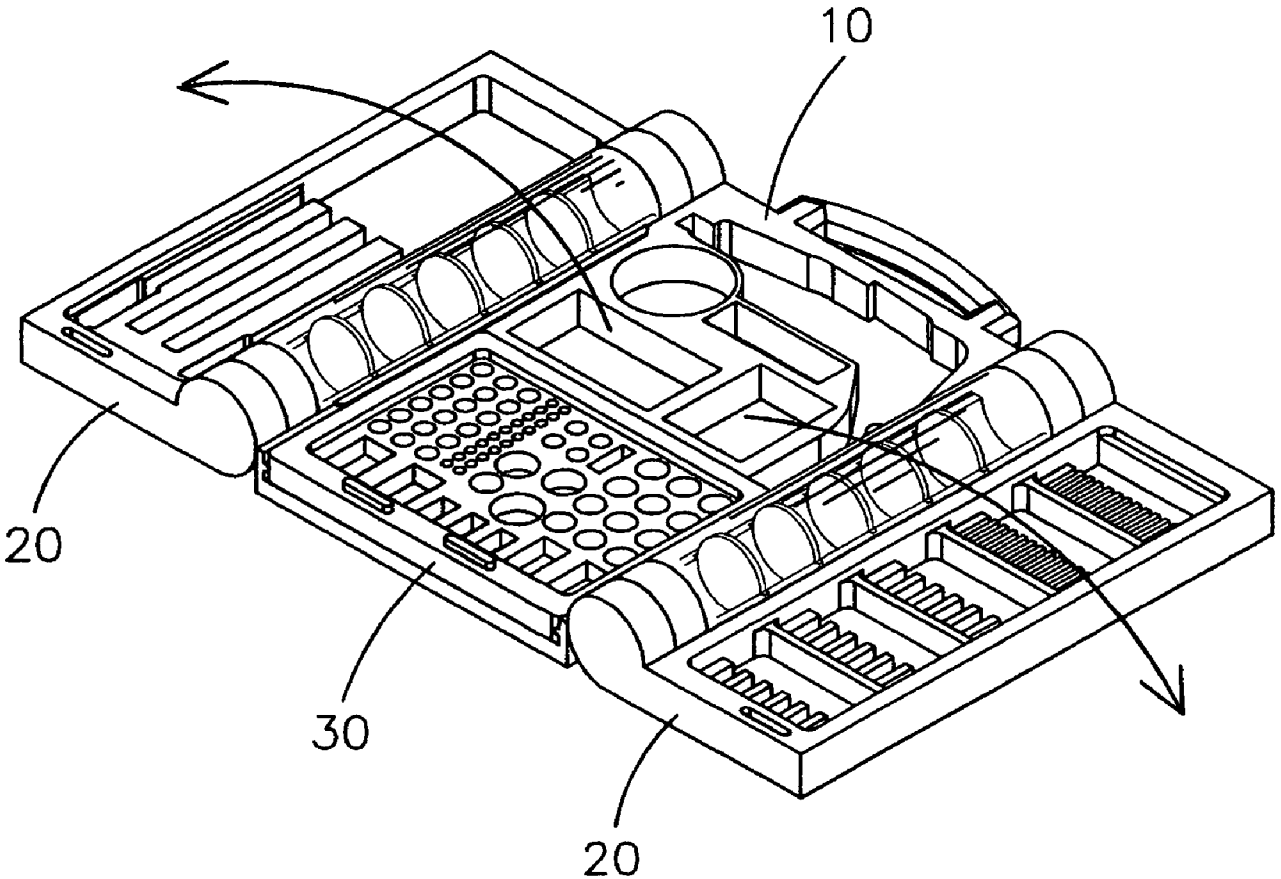
FIG. 4 shows that the two side portions are pivoted to their opened positions.
Figure 5:
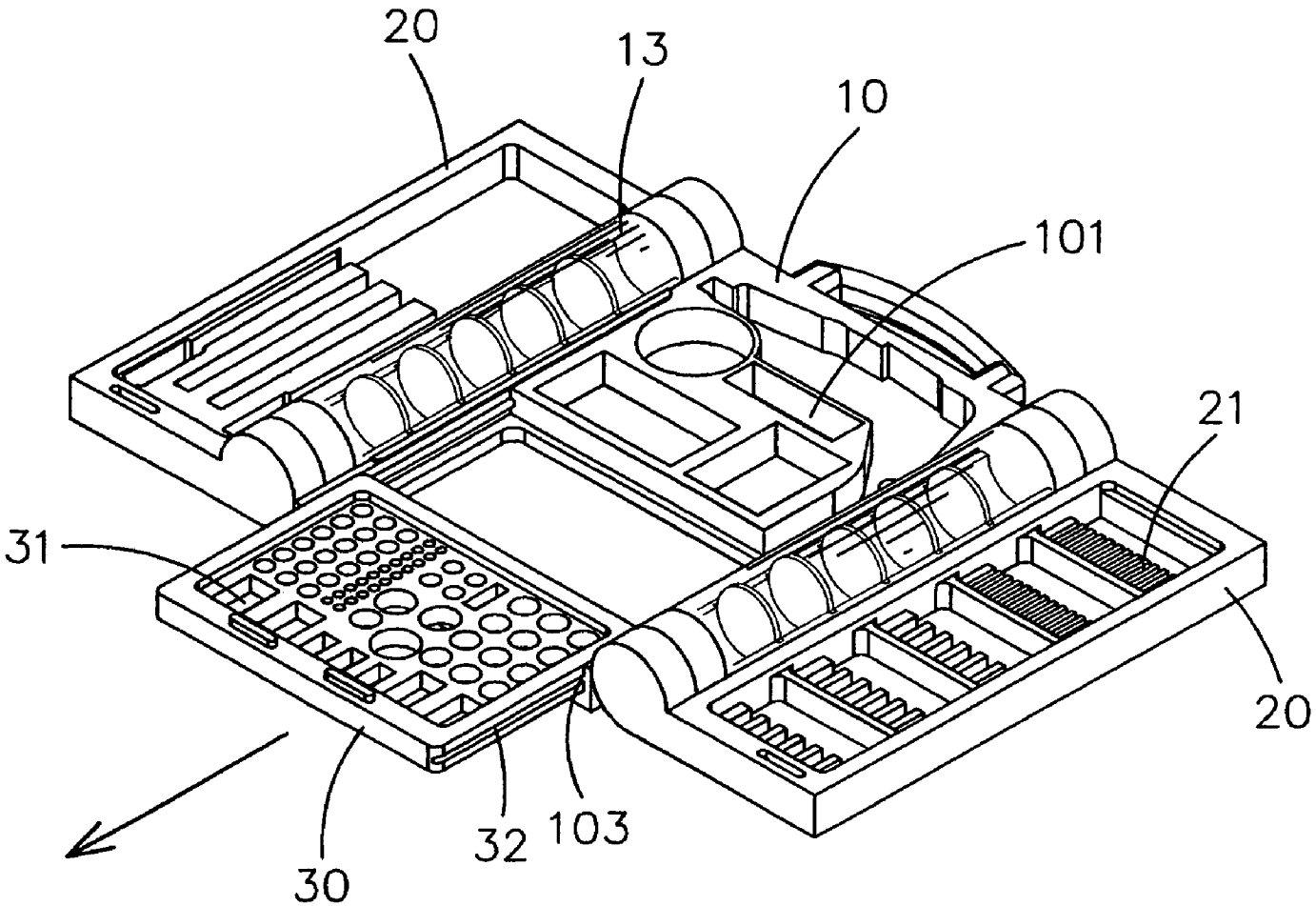
FIG. 5 shows that the slidable portion is slid from the base of the tool box.
Figure 6:
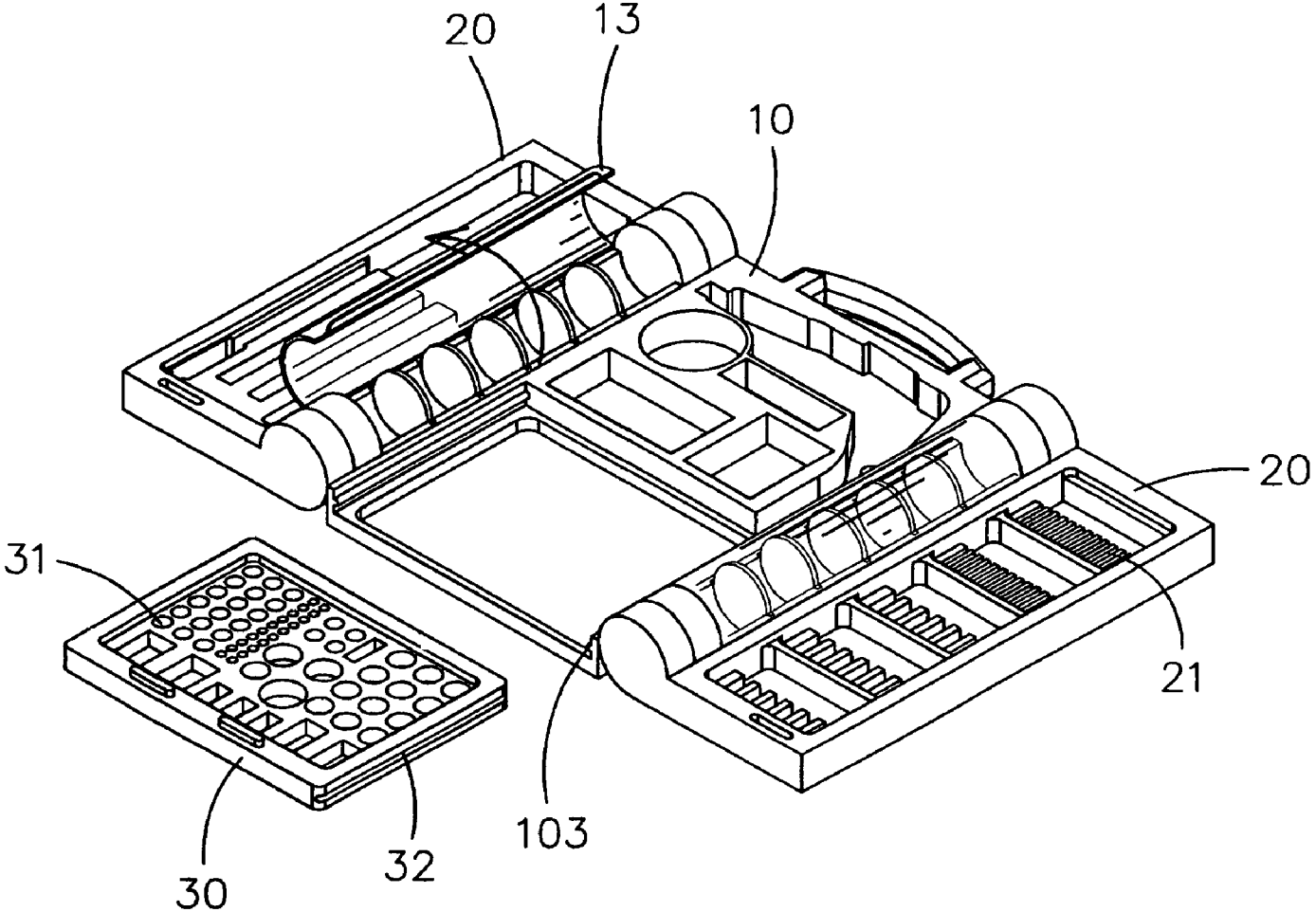
FIG. 6 shows that the two covers on the two side portions are opened.

Two pivotable side portions 20 are pivotably connected to the two connection portions of the base 10 and each side portion 20 has a plurality of second recesses 21 defined therein. Each of the end parts 11 has a protrusion 113 extending from an outside thereof and each of the side portion 20 has two lugs 22 extending from a side thereof, the two lugs 22 each have a dent 221 defined in an inside thereof so that the two lugs 22 are pivotably connected to the two end parts 11 by engaging the protrusions 113 with the dents 221. Each of the connection portions has a transparent cover 13 pivotably connected thereto so as to be engaged with the elongate recess 111. Each cover 13 has one side pivotably connected to the connection portion and a flange 131 extends from the other side of the cover 13, so that the user can lift the flange 131 to open the cover 13. The two side portions 20 are sized to cover a top of the base 10 when the two side portions 20 are in their opened positions as shown in FIG. 3.

The base 10 has a space 102 defined therein which opens to an end of the base 10, and the space 102 is defined by two sidewalls which have two rails 103. A slidable part 30 has two side grooves 32 defined in two sides thereof and the two rails 103 are engaged with the two side grooves 32. The slidable portion 30 is slidably received in the space 102 and has a plurality of third recesses 31 defined therein. Therefore, the slidable portion 30 can be slid from the space 102 and receive more tools and parts.

Figure 7:
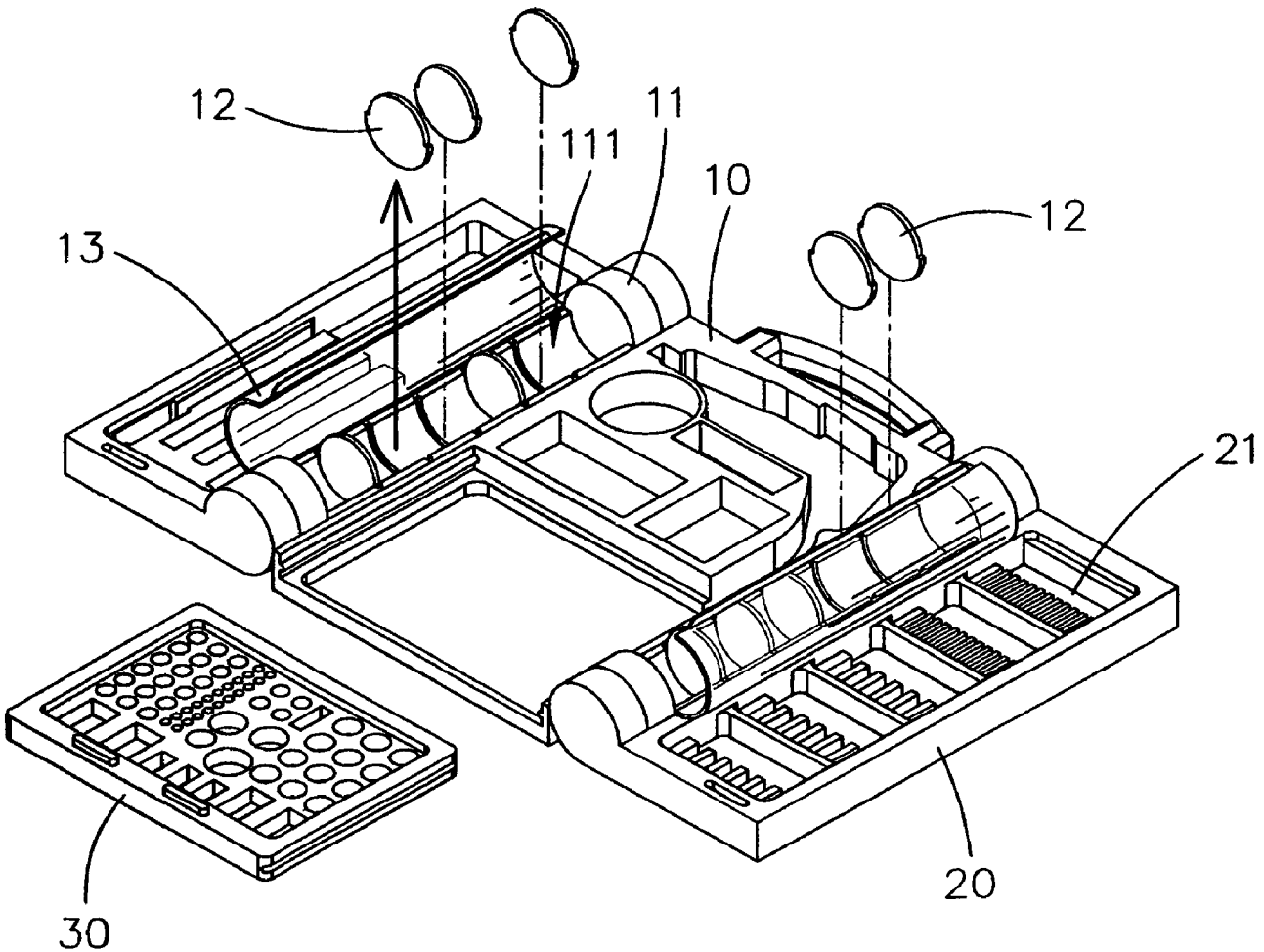
FIG. 7 shows that the separation plates can be removed from the side portions.

The two side portions 20 and the slidable portion 30 can be operated individually so that the tool box can be used in many molds. As shown in FIG. 7, the separation plates 12 can be selectively removed from the elongate recess 111 to receive tools and parts of different sizes.

While we have shown and described the embodiment in accordance with the present invention, it should be clear to those skilled in the art that further embodiments may be made without departing from the scope of the present invention.

What is claimed is:

1. A tool box comprising:

a base having a plurality of first recesses defined therein, two connection portions connected on two sides of the base, each connection portion having two end parts and an elongate recess defined between the two end parts, each of the end parts having a protrusion extending from an outside thereof, each of the connection portions having a cover pivotably connected thereto so as to be engaged with the elongate recess, each of the covers having one side pivotably connected to the connection portion corresponding thereto and a flange extending from the other side of each of the covers, each cover being a transparent cover, substantially visible when the tool box is closed, and two pivotable side portions pivotably connected to the two connection portions of the base and each of the side portions having two lugs extending from a side thereof, the two lugs each having a dent defined in an inside thereof, the two lugs pivotably connected to the two end parts by engaging the protrusions with the dents, each side portion having a plurality of second recesses defined therein, the two side portions being sized to cover a top of the base.

2. The tool box as claimed in claim 1, wherein a plurality of grooves are defined in an inner side of each of the elongate recesses and a plurality of separation plates are engaged with the grooves.

3. The tool box as claimed in claim 2, wherein the grooves are located in equal distance separated apart and each separation plates includes an engaging periphery which is engaged with the groove corresponding thereto.

4. The tool box as claimed in claim 1, a handle is connected to an end of the base.

5. The tool box as claimed in claim 1, wherein the base has a space defined therein which opens to an end of the base, a slidable portion is slidably received in the space and has a plurality of third recesses defined therein.

6. The tool box as claimed in claim 5, wherein the space is defined by two sidewalls which have two rails, the slidable portion has two side grooves defined in two sides thereof, the two rails are engaged with the two side grooves.

* * * * *